United States Patent [19]

Land

[11] 3,990,895

[45] Nov. 9, 1976

[54] SILVER HALIDE, COLOR SCREEN ELEMENTS AND THEIR USE IN FORMING NEGATIVE COLOR IMAGES AND DIFFUSION TRANSFER POSITIVE SILVER IMAGES

[75] Inventor: Edwin H. Land, Cambridge, Mass.

[73] Assignee: Polaroid Corporation, Cambridge, Mass.

[22] Filed: Apr. 23, 1974

[21] Appl. No.: 463,260

[52] U.S. Cl. ..... 96/25; 96/3; 96/29 R; 96/76 R; 96/76 C; 96/80; 96/84 R

[51] Int. Cl.[2] ..... G03C 7/04; G03C 5/54; G03C 1/48; G03C 1/84

[58] Field of Search ..... 96/25, 26, 94 R, 80, 96/76 R, 76 C, 3, 29 R, 84 R, 118

[56] References Cited

UNITED STATES PATENTS

| | | | |
|---|---|---|---|
| 1,988,891 | 1/1935 | Gaspar | 96/25 |
| 2,592,250 | 4/1952 | Davey et al. | 96/94 R |
| 2,614,926 | 10/1952 | Land | 96/80 |
| 2,707,150 | 4/1955 | Land | 96/80 |
| 2,732,305 | 1/1956 | Richman et al. | 96/84 R |
| 2,944,894 | 7/1960 | Land | 96/80 |
| 3,284,208 | 11/1966 | Land | 96/25 |
| 3,536,488 | 10/1970 | Land | 96/118 |
| 3,615,428 | 10/1971 | Weed | 96/25 |
| 3,622,318 | 11/1971 | Evans | 96/74 R |
| 3,677,753 | 7/1972 | Francis et al. | 96/76 R |
| 3,685,991 | 8/1972 | Grasshoff et al. | 96/25 |
| 3,709,693 | 1/1973 | Land | 96/77 |
| 3,721,562 | 3/1973 | Land | 96/3 |
| 3,734,737 | 5/1973 | Sharp | 96/80 |
| 3,793,023 | 2/1974 | Land | 96/3 |
| 3,821,000 | 6/1974 | Land et al. | 96/76 R |
| 3,894,871 | 7/1975 | Land | 96/76 R |

OTHER PUBLICATIONS

Neblettl, *Photography—Its Materials and Processes* 5th Edition, 1962, pp. 442–445.

*Primary Examiner*—David Klein
*Assistant Examiner*—Richard L. Schilling
*Attorney, Agent, or Firm*—Stanley H. Mervis

[57] ABSTRACT

Color photographic products and processes are disclosed which provide a silver image in registration with a light-transmitting screen composed of minute optical elements, such as an additive color screen. The silver image is present in the developed silver halide emulsion layer which is maintained in registered relationship with said screen on a transparent support. Where the silver halide emulsion is negative-working, the silver image is a negative of the photographed subject, and the thus-obtained additive color negative image may be used to form full color positive images by printing onto subtractive color print material.

The undeveloped silver halide may be allowed to remain in the developed silver halide emulsion layer, or all or a portion thereof may be removed from the developed silver halide emulsion layer. If desired, undeveloped silver halide may be transferred to a silver-receptive stratum carried by a separate support to provide a positive silver transfer image which may serve as a "proof" of the developed negative image.

73 Claims, 8 Drawing Figures

SILVER HALIDE, COLOR SCREEN ELEMENTS AND THEIR USE IN FORMING NEGATIVE COLOR IMAGES AND DIFFUSION TRANSFER POSITIVE SILVER IMAGES

This invention is concerned with color photography, and more particularly with photographic products and processes for providing additive color negative images.

The formation of color images utilizing additive color principles and including an optical or additive color screen is per se well known; see, for example, *Photography — Its Materials and Processes*, Neblette, 6th Edition (1962), pp. 431–435. The additive color screen may be an irregular mosaic or a regular geometric pattern, and may be separable or inseparable from the silver halide emulsion. As stated by Neblette, supra, at pp. 424–425:

> If the developed negative is kept with its color filter screen, or placed in contact with an identical screen, the visual appearance of the plate is that of a color negative. Here the brightness of the subject photographed is reversed — as is true with all negative images — and the colors apparent to the eye are approximately complementary to those of the original subject.
>
> Such a color negative may be printed onto a similar screen material to obtain a positive color transparency, or it may be reproduced by rephotographing the color screen and negative with narrow band red, green and blue filters to separate out the three color records of the subject already formed. However, color screen materials have been more often developed by reversal to obtain a positive silver image. If such a silver positive image is viewed through the original taking mosaic screen of filters, or one like it, the colors of the original subject are seen when the plate is viewed by transmitted light. The synthesis of the colors of the original subject is obtained by the additive mixture of the light coming through the many small red, green and blue filters.

As noted at page 433 of Neblette, the once commercial Lumiere (Autochrome), Agfacolor and Dufaycolor additive color films utilized as inseparable additive color screen and were normally processed by reversal to provide an additive color positive transparency. Such reversal processing included the steps of developing the exposed silver halide, bleaching the developed silver image, reexposure, and a second development to provide the desired positive image. The re-exposure step may be replaced by chemical reduction or fogging. It will be seen, therefore, that the intermediate negative image in such processing was a transient image, considered useful only as a means to remove the silver halide which was not to be utilized to provide the positive image. Dufaycolor additive color negative film was commercially used to print onto an additive color positive film; a major problem in such use was the introduction of moire patterns from the least misregistration of the two additive color screens.

The use of additive color principles to provide additive color positive images utilizing silver diffusion transfer technology is, of course, also well known. In such applications, the silver halide emulsion is exposed through an additive color screen and the resultant positive silver transfer image is viewed through an appropriately registered additive color screen. In the most useful diffusion transfer embodiments, the same additive color screen is used in both exposure and viewing.

U.S. Pat. No. 2,614,926 issued Oct. 21, 1952, U.S. Pat. No. 2,707,150 issued Apr. 26, 1955, U.S. Pat. No. 2,726,154 issued Dec. 6, 1955 and U.S. Pat. No. 2,944,894 issued July 12, 1960, all in the name of Edwin H. Land, and U.S. Pat. No. 2,992,103 issued July 11, 1961 in the name of Edwin H. Land and Otto E. Wolff, disclose diffusion transfer additive color processes wherein a silver transfer image is viewed in registration with the additive color screen through which photoexposure was effected. The developed photosensitive layer is removed to permit viewing the resulting additive color transparency. U.S. Pat. Nos. 2,726,154 and 2,861,885 note the possibility of viewing such an additive color transparency without removing the developed silver halide emulsion layer, taking advantage of the fact that the density of the positive image produced is much greater than the density of the negative. Under these circumstances, the highlights of the positive will be grayed to some extent but this is generally unobjectionable, particularly for projection purposes, due to the considerable difference in density between the positive and negative images. U.S. Pat. No. 2,861,885 states:

> It is apparent that the minimum density of the composite print depends, to a substantial extent, upon the maximum density of the negative since the shadows of the negative correspond to the highlights of the positive. If the above-noted ratio of positive silver covering power to negative silver covering power is realized in a composite print to be viewed by reflection, this maximum negative density can be as great as 0.3 without seriously affecting the composite image quality. A substantially higher maximum density is tolerable in the negative when the composite print is used as a transparency because the brightness of the highlights of the composite print is a function of the intensity of illumination. It has been found that a maximum density of as high as 1.0 in the negative is permissible if the maximum density of the composite print is at least 4 times greater. Preferably, then, in a composite image of the foregoing type, the silver halide stratum, when fully developed in any conventional manner, has no greater density than approximately 0.3 if the composite print is to present a reflection image, and has no greater density than approximately 1.0 if the composite print is to serve as a transparency.

Other diffusion transfer processes providing positive silver transfer images viewable without separation from the developed negative image include U.S. Pat. No. 3,536,488 issued Oct. 27, 1970 to Edwin H. Land and U.S. Pat. No. 3,615,428 issued Oct. 26, 1971 to Lucretia J. Weed. In U.S. Pat. No. 3,536,488, the positive silver transfer image and the developed negative image are in the same layer, the silver halide emulsion layer including a silver precipitating agent. Placement of the silver precipitating agent in the silver halide emulsion layer was effective to keep the developed negative density low by limiting the physical expansion of exposed silver halide grains upon development. In U.S. Pat. No. 3,615,428, two positive silver transfer images are formed, one on each side of the silver halide emulsion layers. The copending application of Edwin H. Land, Ser. No. 383,196, filed July 27, 1973, described and claims improved additive color positive processes in which the developed negative silver image and the positive silver transfer image are viewed without separation, the developed negative silver image having very low density.

The above review shows that the additive color diffusion transfer art has recognized on one hand the desirability of discarding the negative silver image obtained as an intermediate in the formation of an additive color positive image, while on the other hand the art has recognized the desirability of keeping the density of the developed negative image very low to permit it to be retained with the additive color positive image, the two images being viewable together as a positive image. Thus, even in additive color diffusion transfer photography the negative silver image has not been of practical significance.

The present invention is concerned with providing photographic products and processes for obtaining additive color negative images, which negatives are useful as true color negatives in their own right.

Accordingly, it is a principal object of the present invention to provide novel photographic products and processes which yield additive color negatives in a rapid and simple manner.

A further object of this invention is to provide novel photographic products and processes which produce additive color negatives which do not require removal of undeveloped silver halide.

Yet another object of this invention is to provide novel photographic products and processes for simultaneously obtaining an additive color negative image and a separate, black-and-white positive silver transfer image.

Still another object of this invention is to provide novel photographic products and processes for forming additive color negatives, which products and processes are adapted to be utilized in a plurality of commercially available "self-developing" cameras.

A further object of this invention is to provide novel photographic products and processes for obtaining additive color negative images wherein the grain size characteristics of the silver halide grains are related to the dimensions of the color screen filter elements in a manner which provides high color resolution during exposure, the silver of the developed negative image having a substantially greater projected area than did the exposed silver halide grains prior to development, to provide useful negative density without significant loss of such high color resolution.

Other objects of the invention will in part be obvious and will in part appear hereinafter.

The invention accordingly comprises the products possessing the features, properties and relation of elements, and the processes including the steps and relation of the steps with respect to each other, which are exemplified in the following detailed disclosure, and the scope of the application of which will be indicated in the claims.

For a fuller understanding of the nature and objects of this invention, reference should be had to the following detailed description taken in connection with the accompanying drawings wherein.

While the preferred embodiments of the present invention incorporate an additive color screen and the invention will be illustrated therewith, it will be understood that other optical screens useful in additive color photography, such as lenticular screens, also may be used. The unique features of the present invention are most readily illustrated, understood and appreciated in the context of an additive color negative transparency which includes, as part of an integral film structure, a transparent support, an additive color screen, and a negative silver image. In such additive color negative images, a particularly useful additive color screen comprises sets of minute color filter elements, the individual filter elements of a given set transmitting light of a predetermined range of wavelengths of visible light, preferably one of the so-called primary color wavelength ranges. Particularly useful additive color screens thus comprise red, green and blue color filter elements, i.e., color filter elements which transmit, respectively, red, green and blue light, each filter element absorbing visible light outside its transmitted red, green or blue wavelength range. These color filter elements are arranged in an interspersed, juxtaposed arrangement to provide a regular repeating pattern well known in the art and customarily referred to simply as an additive color screen. In a particularly useful embodiment, the screen is formed of interspersed red, green and blue lines. The finer the filter elements or lines, the less likely the additive color screen will be resolved during "printing" of the additive color negative.

Figure 5:
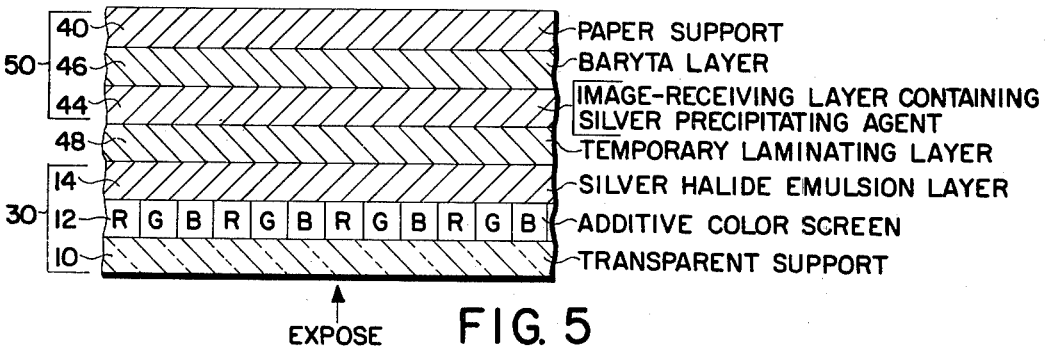
Figure 6:
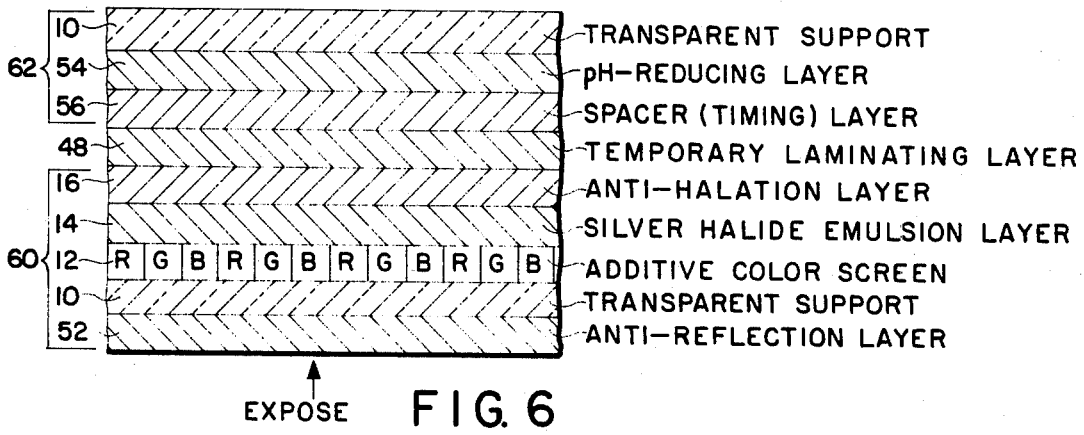
FIG. 6 is a diagrammatic, enlarged, cross-sectional view of yet another photographic product adapted to provide an additive color negative in accordance with another embodiment of this invention.

The usual camera speed silver halide emulsions have a relatively wide distribution of grain sizes, a fact readily apparent from visual examination of the electron micrographs reproduced in FIGS. 5 and 6 of the aforementioned copending application, Ser. No. 383,196. Large silver halide grains are traditionally desirable in camera speed silver halide emulsions because of their usually higher "speed". However, if the silver halide grains are large and an additive color screen is formed of extremely fine filter elements, i.e., the silver halide grains are large relative to the filter element width, an undesirably large number of silver halide grains are likely to be positioned at the border of two different filter elements and thus be exposable by either of two different wavelength ranges of light. This results in reduced color separation and saturation. While small silver halide grains avoid the latter problems, the photographic speed of the small grains is commonly much less than that of the large grains, and the small grains will be inefficiently utilized in the process.

For convenience in the description of this invention, the expressions "additive color negative" and "additive color negative image" are used to refer to the final image. It is to be understood that use of the term "negative" in these expressions is not intended to be limiting, but rather is used in both a generic and a specific sense to refer to the presence of a developed silver halide emulsion layer containing a silver image formed by development of an exposed silver halide emulsion. Thus, where the silver halide emulsion is of the negative-working type, the developed silver image will be a true negative image. If, on the other hand, a direct positive silver halide emulsion is utilized, the developed silver image will be a true positive image of the photographed subject matter. The present invention contemplates the use of either negative-working or direct positive silver halide emulsions, the developed silver halide emulsion being part of an integral structure including a transparent support and an optical screen, such as an additive color screen or a lenticular screen.

The present invention provides photographic products and processes for forming additive color transparencies comprising an additive color screen on the same support as a developed silver halide emulsion layer containing an image in silver, and particularly additive color negative images, having desirable maximum and minimum densities and exhibiting large dynamic ranges and high color quality.

In accordance with this invention, it has been found that highly useful additive color transparencies comprising an additive color screen and a silver image in a developed silver halide emulsion layer carried by the same transparent support may be obtained by a silver halide emulsion having characteristics defined in more detail hereinafter, and effecting development of the exposed silver halide emulsion under conditions effective to provide a substantial increase in the projected area of the image silver as compared with the projected area of the developable silver halide grains. It will therefore be seen that development conditions will be selected to provide a substantial expansion of the silver halide grains which are developed. Undeveloped silver halide may be retained in the developed silver halide emulsion layer, either as undeveloped silver halide grains or in the form of a silver or silver halide complex. Alternatively, part or all of the undeveloped silver halide may be removed from the developed silver halide emulsion layer; in a particularly useful embodiment, undeveloped silver halide may be dissolved and transferred to a silver receptive stratum carried by a separate support to provide a black-and-white positive silver transfer image which may serve as a proof of the additive color negative image.

In a preferred embodiment of the invention, the silver halide emulsion has a predominantly homogeneous grain size distribution. The average grain size of the silver halide emulsion is selected to provide a highly advantageous relationship between the projected area of the silver halide grains and the minimum dimension (width) of the individual optical filter elements, thus providing high color resolution. The mean diameter of the silver halide grains should be about 1/5 to 1/10 the width of the color filter elements. In general, the silver halide grains should have a mean diameter within the range of about 0.7 to 1.5 microns. Where the additive color screen is a very fine screen, as in the Super 8 movie image size, the silver halide grain mean diameter will preferably be within the range of about 0.7 to 1.0 micron, and most preferably a mean diameter of about 0.8 to about 0.9 micron. In particularly useful embodiments, at least 90% of the silver halide grains should have a diameter within ± 30% of the mean diameter. Where the image format is larger, as in the case of 35 mm or 3¼ × 4¼ transparencies, a coarser screen may be satisfactory and the mean diameter of the silver halide grains may be larger, e.g., within the range of about 1.2 to 1.4 microns. (Silver halide emulsions satisfying the above criteria would be recognized by those skilled in the art as being "narrow" in grain size distribution; indeed, such silver halide emulsions would be significantly narrower in grain size distribution than any ordinary commercially utilized camera speed silver halide emulsion.) The silver halide emulsion may be coated as a "single grain layer" or "monolayer" of silver halide grains, i.e., the silver halide emulsion is substantially free of overlapping silver halide grains, although the silver halide emulsion layer itself may be thicker than the silver halide grains. The silver halide grains in the coated emulsion layer advantageously are relatively uniformly distributed and are free of clusters of grains which would have a diameter approaching the width of a color filter element. The silver halide emulsion is preferably coated at a silver to gelatin ratio of about 1:1 to 1:1.5 by weight.

Individual silver halide grains have, of course, finite dimensions and one frequently describes silver halide emulsions, inter alia, in terms of the "mean diameter" of the silver halide grains thereof. The silver halide grains of the silver halide emulsions used in this invention are preferably "regular" in crystal habit, i.e., they are generally polyhedra of three-fold symmetry, such as spheres, cubes, octahedra, and nearly spherical, rounded-off octahedra such as plates or platelets. "Three-fold symmetry" is used here to mean symmetry about three mutually perpendicular axes.

The "projected area" of an individual silver halide grain or developed silver grain is the area of the maximum plane section which may be drawn through the grain parallel with the surface of the layer in which said grain is disposed. The projected area of the grain thus corresponds to the area of the shadow which would be cast if one projected a light through the layer containing said grain, and it is a measure of the area over which the grain will block transmission of light through said layer. The sum of the projected areas of all the silver halide grains in a given silver halide emulsion layer will be the sum of the projected areas of the individual grains minus any overlapping projected area of overlapping grains.

As noted above, in the preferred embodiments the silver halide emulsion has a mean grain diameter within the range of about 0.7 to 1.0 microns, preferably a mean diameter of about 0.8 to about 0.9 micron. Assuming a silver halide grain of diameter 0.9 micron is a sphere, such a grain would have a projected area of 0.64 square micron. A silver halide sphere 0.87 micron in diameter would have a projected area of 0.6 square micron. It will therefore be seen that ony may express the grain size characteristics of a silver halide emulsion in terms of the mean projected area of the silver halide grains. In such terms, the mean projected area of the silver halide grain of the predominantly homogeneous emulsion used in the preferred embodiments of this invention is about 0.6 square micron, and at least 90% of the silver halide grains of said emulsion should have a projected area within the range of approximately 0.5 to 1.7 times said the projected area.

The silver halide emulsion preferably is coated to provide a layer of silver halide grains of such diameter and so distributed that if said silver halide grains were developed to silver without expansion, the sum of the projected areas of all the silver halide grains would be about 50 to 60% of the surface area of the corresponding portion of the silver halide emulsion layer. If the sum of said projected areas is 50%, the transmission density of such developed silver would be 0.3. If the sum of the projected areas is 60%, the transmission density would be 0.4. Thus it will be seen that if the unexposed silver halide grains of a silver halide emulsion retained in the developed silver halide emulsion layer without being converted into a silver halide complex were to "print out" after processing, the resultant transmission density of a completely unexposed area would be about 0.3 to 0.4 if the sum of the projected areas of said unexposed silver halide grains were about 50 to 60%.

If the sum of the projected areas of the developed negative silver grains in a fully exposed area is about 84%, that portion of the negative image will transmit approximately 16% of the light projected thereon and have an optical transmission density of approximately 0.8. In general, 0.8 is the lowest negative maximum density which is practicable to print. In the preferred embodiments of this invention, the exposed silver halide grains are developed under conditions which encourage their growth (expansion) during development such that the sum of the projected areas of the developed silver grains will be about 94 to 96%, and the maximum transmission density of the developed negative image will be about 1.2 to 1.4

The "delta" ($\Delta$) or difference between the maximum and minimum densities of the negative silver image should be at least about 0.7 density units (transmission). It should be understood, however, that the maximum densities of the individual red, green and blue color records may vary slightly, particularly if the image silver is not neutral in tone. Additive color negatives useful in printing multicolor positive images on conventional color print may have a density delta as low as 0.7 but best results are obtained where this delta is at least 0.9 density units.

The preferred silver halide emulsions used in this invention have been described as being predominantly homogeneous in grain size, and preferable grain size distributions have been noted. Silver halide emulsions of narrow grain size distribution are not, per se, novel, and techniques for obtaining such silver halide emulsions are well know. Such techniques include physical separation and removal of grains smaller and/or larger than desired. Silver halide emulsion manufacturing procedures also are known which are adapted to produce narrow grain size distribution emulsions. It should be understood, however, that the silver halide emulsions should not only be predominantly homogeneous in grain size distribution, but the emulsion should also be one whose characteristic curve or photographic response is substantially independent of grain size distribution. In emulsions of wide grain size distribution, the characteristic curve is the result of the individual responses of a plurality of grain size families. Indeed, when one separates a particular grain size family of grains, the resulting silver halide emulsion is frequently a high contrast emulsion. The present invention, however, utilizes silver halide emulsions which are predominantly homogeneous in grain size (and therefore have similar solubility characteristics) and have a photographic response substantially independent of grain size. This latter characteristic may be considered to contemplate a mixture of silver halide grains of about the same diameter but which vary in their sensitivity, i.e., in their response in the diffusion transfer process. Homogeneous grain size silver halide emulsions maximize the ability of the silver halide layer to record information during photoexposure without increasing the total projected area of a given silver halide coverage.

Techniques for removing silver halide grains below and/or above a predetermined size or size range from a silver halide emulsion, e.g., by centrifugal separation, are known in the art and may be utilized in obtaining silver halide emulsions which are predominantly homogeneous in grain size. Silver halide emulsions of the type contemplated for use in the present invention may also be prepared by blending several silver halide emulsions or emulsion fractions each having substantially the same grain size but sensitized to different levels or speeds.

It has been determined, e.g., by vacuum deposition of silver substantially uniformly on a transparent support in a stratum 0.1 to 0.15 micron thick, that 100 mg. per square foot of high covering power silver is sufficient to provide a transmission density of 3.0. It has further been determined that if 100 mg. of silver per square foot is provided in the form of silver halide spheres approximately 0.87 micron in diameter and coated in a layer one grain thick, (i.e., the silver halide layer is substantially free of overlapping silver halide grains), the silver halide grains will have a total projected area of 50% or less of the surface area of the silver halide emulsion layer. If this silver halide layer is given a full or maximum density exposure and the exposed silver halide grains developed to provide silver grains or particles which have substantially the same projected area as the silver halides had, the fully exposed and developed silver halide emulsion layer will have a maximum transmission density of 0.3. Accordingly, the present invention contemplates that the development of the developable silver halide grains will be effective to substantially increase the projected area of developed silver halide grains, so that the desired density may be obtained. To the extent there is overlap of the silver or silver halide grains, the total projected area will be reduced, and the transmission density of the negative silver image will also be reduced. Since the silver halide grains in practice will not be perfect spheres, reference to 0.87 micron as the desired grain diameter when 100 mg. of silver is used is intended to be a guide to those skilled in the art in selecting and coating silver halide emulsions in the practice of this invention. As one uses grains having a diameter larger than about 0.9 micron, the percentage of area covered is reduced, and conversely the total projected area increases as the grain diameter is reduced. (No overlapping of grains is assumed.) Of particular significance is the rapidity of the rate of increase in total projected area as the mean grain diameter is reduced, while the rate of change is much slower as the mean grain diameter is increased.

In the practice of the present invention, good quality additive color negatives have been obtained using silver halide emulsions coated at a silver coverage of about 90 to about 200 mg./ft.$^2$, using silver halide emulsions having a mean grain diameter of about 0.8 to about 0.9 micron.

Further understanding of the present invention will be facilitated by a discussion at this point of some of the accompanying drawings.

Figure 1:
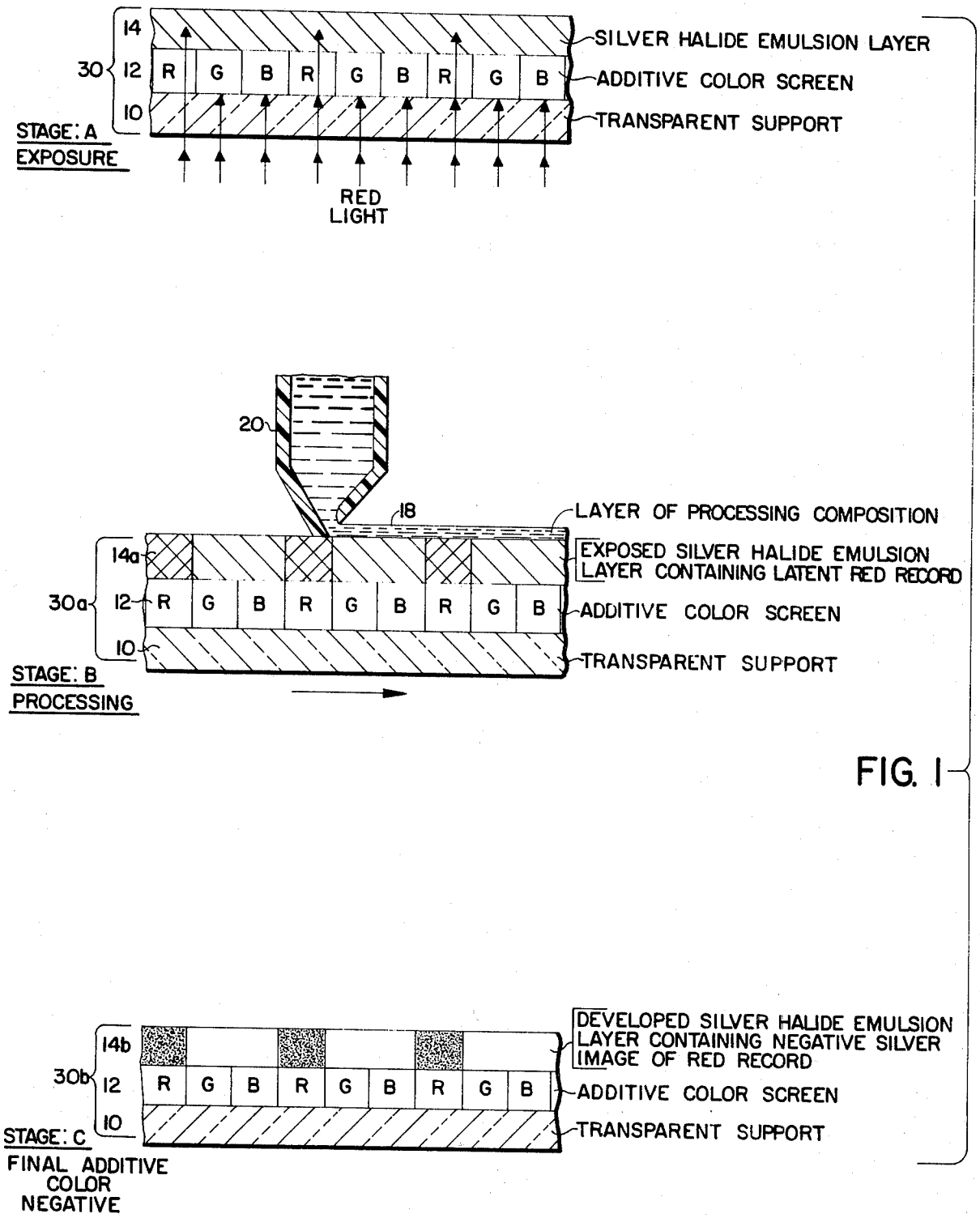
FIG. 1 is a diagrammatic, enlarged cross-sectional view of one embodiment of the present invention during the three illustrated stages of the formation of an additive color negative image, i.e., the photoexposure, processing and final additive color negative image.

In FIG. 1 there is schematically illustrated a film 30 for forming an additive color negative transparency 30*b;* this embodiment is particularly applicable to processing of a series of exposed frames, such as would be present in a movie film. Film 30 comprises a transparent support 10 carrying an additive color screen 12 composed of alternating red, green and blue filter segments or elements (designated R, G and B, respectively), and a silver halide emulsion layer 14. In Stage A, an exposure of the silver halide emulsion 14 through the additive color filter 12 is assumed to be only to red light, and of an intensity sufficient to fully expose the silver halide. Under these conditions, silver halide behind the red filter elements R will be exposed by red light transmitted therethrough, while the silver halide behind the green and blue filter elements G and B will not be exposed, as the red light will be absorbed before reaching the silver halide. The resulting exposed silver halide emulsion layer 14*a* (Stage B) contains a latent image of the red record. Development is effected by application of a processing composition 18 onto the silver halide emulsion side of the exposed film 30*a*. As illustrated in Stage B, a processing composition 18 is applied from a reservoir or container 20 having a slot or nozzle adapted to meter on a predetermined quantity of the processing fluid as a function of the rate at which the exposed film is feed past the container 20 nozzle. The processing composition develops the latent image to a negative silver image 14*b* in registered relationship with the red filter elements R. The developed silver image has a substantially greater total projected area than the projected area of the developable silver halide grains; the expansion of the silver halide grains is effective to provide the desired increase in projected area. The unexposed silver halide behind the green and blue filter elements G and B is not developed, but is converted to a stable silver complex or otherwise rendered harmless from the standpont of providing optical density. Viewing of the developed additive color negative 30*b* by white light projected through the developed silver halide emulsion layer 14*b* and the additive color screen 12 provides a complementary colored, i.e., cyan, negative image reproducing the red record of exposure Stage A.

In the practice of the present invention, it is not necessary to remove the applied layer of processing composition from the developed silver halide emulsion layer. Accordingly, this embodiment of the invention is particularly useful where the film is a movie film and is exposed, developed and projected without being removed from the cassette within which it is provided. Such a cassette contains a supply reel, a take up reel, a reservoir of processing fluid and a suitable aperture for exposure and projection. After exposure of the complete reel of film, the exposed film is advanced past a fluid application station (cf. container 20 in FIG. 1, Stage B) where a processing fluid is applied as the film is rewound, i.e., returned from the take up reel to the supply reel, with the applied processing fluid confined between film convolutions. After a suitable time lapse following completion of the film rewinding to permit completion of development, the film is again advanced from the supply reel to the take-up reel past a projection station permitting viewing of the finished additive color negative movie film. The processing fluid is not removed from the developed film, and the wet developed film is dried during the projection stage. In a typical embodiment of this type, the processing fluid may be applied in a layer approximately 0.0005 inch thick, and the elapsed time between the application of processing fluid to the end of the exposed film and the projection of that portion of the film may be about 10 inches. It will be understood that the development should be completed during this time period, notwithstanding the fact that much longer time may elapse between application of the processing fluid and projection of the other end of the strip of movie film. Details of such in-cassette processing are described in a number of patents including U.S. Pat. Nos. 3,608,455; 3,615,127; 3,616,740; 3,643,579; and 3,687,051 to which reference may be made for more detailed descriptions. If desired, of course, such film may be developed and viewed in a continuous operation without an intervening wind up operation by providing a suitable dark storage area for the developing film between the processing fluid application station and the viewing or projection station. The resulting negative movie film may be viewed as a positive film on a television tube by electronic systems known in the art. One advantage of thus electronically viewing a negative movie film as a positive is that the brightness and contrast may be varied and, indeed, the positive film may be viewed as if it had been exposed at a higher exposure index.

As indicated above and illustrated in FIG. 1, the additive color film of this invention comprises a transparent support carrying an additive color screen and a silver halide emulsion, and these layers are retained together, in registered relationship, as a permanent laminate after processing. This laminate does not include a silver transfer image, and the photosensitive element does not include a silver precipitating image.

The additive color screen per se may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of trransmitting visible light within a predetermined wavelength range. In the most common situations, the additive color screen is trichromatic and each set of color filter elements transmits light within one of the so-called primary wavelength ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124 issued Jan. 30, 1962 to Howard G. Rogers. Another method of forming a suitable color screen comprises multi-line extrusion of the type disclosed in U.S. Pat. No. 3,032,008 issued May 1, 1962 to Edwin H. Land, David S. Grey and Otto E. Wolff, the colored lines being deposited side-by-side in a single coating operation.

A particularly useful and preferred additive color screen comprises red, green and blue stripes or lines in a regularly repeated pattern. The "width" of each of the color filter elements may be varied according to the use to which the final additional color transparency will be put. In general, the greater the expected enlargement of the additive color transparency, e.g., when projected on a viewing screen, the smaller the filter elements should be to ensure that the viewer will not "see", i.e., be able to resolve, the color screen independently of the additive color image. The width of the filter elements thus limits the degree of magnification acceptable in viewing the final image. In general, it has been found that screens composed of approximately 550 triplet sets of red, green and blue lines per inch (i.e., 550 lines per color per inch, each triplet set of lines having a combined width of about 45 microns) is useful if a 35 mm (24 × 36 mm) or a 3¼ × 4¼ inch transparency is desired, approximately 750 triplet sets per inch if the film is of the 16 mm type, and approximately 1,000 triplet sets per inch if the film is of the Super 8 type. Obviously, the finer screen also may be used with larger image films if so desired; such use provides the ability to print enlargements without evidence of the additive color screen, as will be demonstrated in the specific examples. In a typical additive color screen particularly useful in providing additive color movie film having a standard Super 8 image area, each red, green and blue line is about 8 microns wide, and each triplet set of red, green and blue lines is about 24–25 microns wide.

A particularly preferred process for the production of the color screen comprises the process set forth in U.S. Pat. No. 3,284,208, issued Nov. 8, 1966 to Edwin H. Land, which includes successively coating the smooth surface of a lenticular film with a plurality of photoresponsive layers and sequentially subjecting these coatings to radiation focused by the lenticules to provide selective exposure of the coating. Subsequent to each exposure, unexposed portions of the coating are removed and the resultant resist is dyed to provide a set of chromatic filter elements, after which the next succeeding photoresponsive layer is applied. Each such exposure is effected by radiation incident on the lenticular film at an angle calculated to provide the desired plurality of color filter element sets in substantial side-by-side or screen relationship, with each color set effective to filter predetermined wavelengths of light. Where the additive color screen is trichromatic, e.g., the conventional red, green and blue, the exposed portion of each photoresponsive area will generally comprise about one-third of that layer. Although all three exposures may be accomplished by radiation incident on the lenticules of the lenticular film at three separate angles so calculated that each exposure exposes about one-third of the area behind each lenticule, it will be seen that the final color filter element formation may be effected by exposing the last photoresponsive coating to diffuse radiation, relying upon the previously formed color filter elements to prevent undesired exposure.

Subsequent to formation of the first and second series of filter elements, the lenticular configuration is reconstituted as a continuous, smooth surface. If the lenticules comprise a separate stratum temporarily affixed to the surface of the support on which the color screen is formed, that separate stratum may be stripped from the support. Where the lenticules are integral with the film base or support and have been provided by pressure and/or solvent deformation of the base, a continuous smooth surface may be reconstituted by application of a suitable solvent to release the deformation pressures produced during the manufacturing of the lenticular film base; if desired, for example, for optical transmission purposes, the reconstituted suface may be polished, for example, by surface contact with an appropriate rotating polishing cylinder or drum, to provide the desired optical characteristics to the film base surface.

The external suface of the color screen is preferably overcoated with an alkali resistant protective polymeric composition, such as cellulose acetate butyrate, polyvinyl butyral, polyvinylidene chloride, and the like, to protect the screen filter dyes from attack by the diffusion transfer processing composition used to process the film. The other layers of the film may then be coated over this protective layer.

Suitable apparatus for effecting the described exposure of the lenticular film is disclosed, for example, in U.S. Pat. No. 3,318,220, issued May 9, 1967 to Glenn J. Battaglia and Gregory E. Linden.

The transparent support or film base employed may comprise any of the known types of transparent photographically useful rigid or flexible supports, for example, glass, polymeric films of both the synthetic type and those derived from naturally occurring products, etc. Expecially suitable film bases comprise polyesters such as the polymeric films derived from ethylene glycol and terephthalic acid and commercially available under such tradenames as Mylar and Estar; and polymeric cellulose derivatives such as cellulose triacetate or cellulose acetate butyrate.

Figure 2:
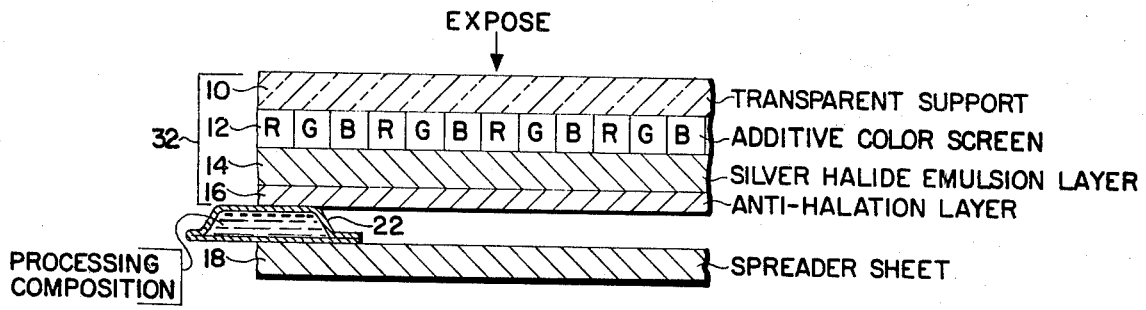
FIGS. 2 and 4 are diagrammatic, enlarged, cross-sectional views of photographic products adapted to provide an additive color negative in accordance with certain embodiments of this invention.

As illustrated in FIG. 1, an exposed film may be processed by applying a thin layer of a processing composition to the liquid-permeable suface of the film. As an alternative method of processing such a film, mention may be made of tray or tank development. Thus, for example, the film may be slit and perforated in a standard 35 mm width and length and processed in a conventional developing tank for 35 mm film.

Where the additive color film is of a size conventional for individual frames, e.g., a 4 × 5, 3¼ × 4¼ or 2¼ × 2¼ size, one may conveniently process an exposed frame in a manner similar to those used in processing diffusion transfer films, e.g., by using a second sheet-like element as a spreader sheet and a rupturable container or pod of an appropriate processing composition. One such film unit is illustrated in FIG. 2, wherein a photosensitive element 32 comprises a transparent support 10, carrying, in sequence, an additive color screen 12, a silver halide emulsion layer 14, and an anti-halation layer 16. Following photoexposure through the transparent support 10, the exposed photosensitive element 32, a spreader sheet 18, and a rupturable container 22 are passed between a pair of pressure applying members (not shown), such as a pair of pressure rolls of the type used in self-developing cameras. Application of pressure to the rupturable container 22 causes the container to open along a predetermined edge and release the processing composition for distribution between the superposed photosensitive element 32 and the spreader sheet 18. The spreader sheet 18 serves to confine the processing composition between the superposed sheets and to aid in uniform distribution of the processing composition. After a suitable processing period, the spreader sheet 18 is removed. In a preferred embodiment, the layer of processing composition adheres preferentially to the spreader sheet 18 so that it is removed from the developed photosensitive element 32 when the spreader sheet 18 is removed.

Figure 3:
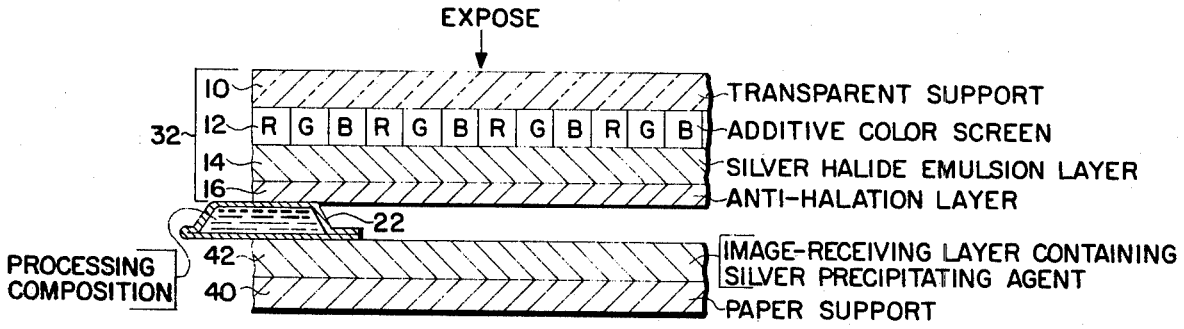
FIGS. 3 and 5 are diagrammatic, enlarged, cross-sectional views of photographic products adapted to provide an additive color negative and a separate, black-and-white positive silver transfer image in accordance with other embodiments of this invention.

As noted above, it is within the scope of this invention to remove at least a portion of the undeveloped silver halide and to use such removed silver halide to form a positive silver transfer image of the silver image developed in the silver halide emulsion layer. A film unit which may be so processed is illustrated in FIG. 3 and differs from that illustrated in FIG. 2 by the replacement of the spreader sheet 18 with a diffusion transfer image-receiving element comprising a paper support 40 carrying a silver receptive stratum 42, e.g.., an image-receiving layer containing a silver precipitating agent. Exposure and processing is effected as with the film unit shown in FIG. 2. After a predetermined processing period, the image receiving element is separated. The thus obtained positive black-and-white silver transfer image may be utilized as proof of the additive color negative image in the developed photosensitive element 32. In accordance with well known techniques, e.g., the provision of a stripping layer, the layer of processing composition distributed between the superposed photosensitive and image-receiving elements may be caused to preferentially adhere to either element, e.g., the element which did not include the stripping layer, upon separation of said elements at the end of the processing period.

Figure 4:
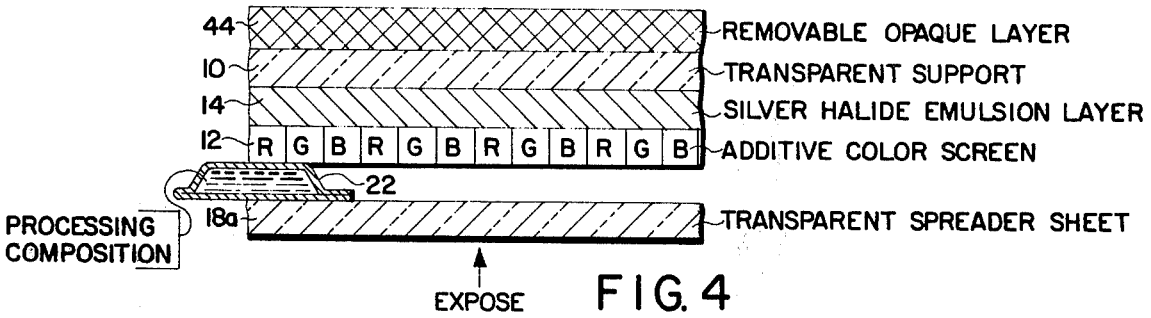

The film units illustrated in FIGS. 2 and 3 may have both sheet-like elements in superposed relationship prior to photoexposure, and are processed in the dark. If it is desired to process the exposed film unit in a lighted area, suitable means to prevent further exposure (fogging) must be provided. One such technique is to provide the photosensitive element with a removable opaque layer on the back thereof, and to process with an opaque spreader sheet or with a processing fluid containing a suitable opacifying agent(s). As illustrated in FIG. 4, such a photosensitive element may comprise a transparent support 10 carrying on one side thereof a removable opaque layer 44 and carrying on the other side thereof a silver halide emulsion layer 14 and an additive color screen 12. If one uses a transparent spreader sheet 18*a*, as illustrated in FIG. 4, the transparent spreader sheet 18*a* may be superposed on the photosensitive element prior to photoexposure, the silver halide emulsion layer 14 being exposed through the additive color screen 12 and the transparent spreader sheet 18*a*. If it is desired to utilize a spreader sheet which is opaque instead of transparent, the opaque spreader sheet should be out of the optical path during photoexposure. In the embodiment shown in FIG. 4, the additive color screen 12 is permeable to the processing composition, the dyes (pigments) used in the color filter elements being nondiffusible and not bleached by the processing composition.

As examples of suitable removable opaque layers, mention may be made of pressure sensitive opaque layers, such as those described in the copending application of Richard W. Young, Ser. No. 403,038 filed Oct. 3, 1973 (now abandoned), and of opaque layers removable by swelling in an aqueous solution, such as those described in the copending application of Richard W. Young, Ser. No. 403,037 filed Oct. 3, 1973, now U.S. Pat. No. 3,881,932 issued May 6, 1975.

The provision of an anti-halation layer 16 provides beneficial results by minimizing lateral back scatter of light which has passed through the silver halide emulsion layer 14, particularly in areas of high exposure, with consequent dilution of color saturation and separation. The anti-halation dyes are preferably selected for their ability to be rendered colorless by the processing composition, e.g., by sodium sulfite included in the processing composition. If the developed photosensitive element is to be given further treatment after development is completed, e.g., to remove an opaque back layer 44, the reagent required to bleach or remove the anti-halation dyes may be included in the composition used to effect such aftertreatment. Suitable anti-halation layers are described in the copending application of Edwin H. Land, Ser. No. 383,261 filed July 27, 1973. In a particularly useful embodiment, gelatin is used as the binder for the anti-halation layer. The anti-halation layer may also include a noble metal silver image stabilizing agent, e.g., a substantially water-insoluble gold compound of the type described in U.S. Pat. No. 3,704,126 issued Nov. 28, 1972 to Edwin H. Land, Stanley M. Bloom and Leonard C. Farney.

As noted above, certain embodiments of this invention include the provision of a positive silver transfer image of the silver image developed in the developed silver halide emulsion layer. Image-receiving layers for forming silver transfer images are well known in the art and include one or more silver precipitating agents in a suitable matrix or binder, e.g., colloidal silica, regenerated cellulose, gelatin, etc., to provide a vigorous silver precipitating system.

Suitable silver precipitating agents are well-known in the art and are described, for example, in the several patents mentioned above as describing silver transfer processes. Particularly useful silver precipitating agents include the heavy metal sulfides and selenides and the colloidal metals described in said patents and in, for example, U.S. Pat. No. 2,698,237 issued Dec. 28, 1954 to Edwin H. Land. It is preferred to use sulfides whose solubility products in an aqueous medium at approximately 20° C. are between $10^{-23}$ and $10^{-30}$, and especially the sulfides or selenides of zinc, copper, cadmium and lead. The silver precipitating agents are used in low concentrations, e.g., in the order of about $1\text{–}25 \times 10^{-6}$ moles per square foot. Where the silver precipitating agent is one or more of the heavy metal sulfides or selenides, it is desirable to prevent the diffusion and wandering of any excess sulfide or selenide ions which may be present, by also including, in the silver precipitating layer or in a separate layer adjacent thereto, at least one metallic salt which is substantially more soluble in the processing agent than the heavy metal sulfide or selenide used as the silver precipitating agent and which is irreducible in the processing agent. This more soluble salt has, as its cation, a metal whose ion forms sulfides or selenides which are difficulty soluble in the processing agent and which give up their sulfide or selenide ions to silver by displacement. Accordingly, in the presence of sulfide or selenide ions the metal ions of the more soluble salts have the effect of immediately precipitating the sulfide or selenide ions from solution. These ion-capturing salts may be soluble salts of cadmium, cerium (ous), cobalt (ous), iron, lead, nickel, manganese, thorium, and tin. Satisfactory soluble and stable salts of the above metals may be found among the acetates, nitrates, borates, chlorides, sulfates, hydroxides, formates, citrates, or dithionates thereof. The acetates and nitrates of zinc, cadmium, nickel, and lead are preferred. In general, it is also preferable to use the white or lightly colored salts.

The above mentioned ion-capturing salts may also serve a function of improving the stability of the positive image provided they possess, in addition to the aforementioned characteristics, the properties specified in U.S. Pat. No. 2,584,030 issued Jan. 29, 1952 to Edwin H. Land. For example, if the ion-capturing salt is a salt of a metal which slowly forms insoluble or slightly soluble metallic hydroxides with the hydroxyl ions in the alkaline processing liquid, it may contribute to reducing the alkalinity of the film unit, thereby aiding in the prevention of undesirable developer stains.

In certain embodiments of this invention, it is advantageous to temporarily bond or laminate the photosensitive element to the spreader sheet or the image-receiving element. Examples of such temporarily laminated film units are shown in FIGS. 5 and 6.

In FIG. 5, a photosensitive element 30 comprising a transparent support 10 carrying, in sequence, an additive color screen 12 and a silver halide emulsion layer 14, is temporarily laminated to an image-receiving element 50 by a temporary laminating layer 48. The image-receiving element 50 comprises a paper support 40 carrying, in sequence, a baryta layer 46 and a silver image-receiving layer 44. The baryta layer 46 is effective to increase film speed by reflecting light back to the silver halide emulsion layer 14; by tinting the baryta layer 46 slightly grey one may also impart anti-halation properties to the baryta layer. After photoexposure, distribution of the processing composition is effective to delaminate the photosensitive element 30 from the image-receiving element 50. The formation of such prelaminated film units and their delamination by the processing composition is described, for example, in U.S. Pat. No. 3,625,281 to Albert J. Bachelder and Frederick J. Binda and in U.S. Pat. No. 3,652,682 to Edwin H. Land, both issued Mar. 28, 1972, and in U.S. Pat. No. 3,793,023 issued Feb. 19, 1974 to Edwin H. Land.

Prelaminated film units of the type shown in FIG. 5 are intended to be separated after processing is completed. A prelaminated film unit which may be retained as a permanent laminate is illustrated in FIG. 6 wherein a photosensitive element 60 is shown as laminated to a spreader sheet 62 by a temporary laminating layer 48. The photosensitive element 60 comprises a first transparent support 10 carrying on one side thereof an additive color screen 12, a silver halide emulsion layer 14, and an anti-halation layer 16. On the other side of the transparent support 10 there is optionally provided an anti-reflection coating 52. The spreader sheet 62 comprises a second transparent support 10 carrying, in sequence, a pH-reducing layer 54 and a spacer or timing layer 56. In use, a processing composition is distributed between the anti-halation layer 16 and the timing layer 56 by rupturing the bond provided by the temporary laminating layer 48. Permeation of the processing composition into the exposed silver halide emulsion layer 14 is effective to develop the negative silver image. After a predetermined interval, the processing composition permeates through the timing layer 56 and into the pH-reducing layer 54, preferably a layer of a polymeric acid. The pH-reducing layer functions to reduce the pH of the system, thereby stabilizing the developed silver halide emulsion layer 14. Salt-forming components of the processing composition may be captured by the pH-reducing layer, thereby further stabilizing the system by preventing such components of the processing composition from crystallizing out as the developed laminate dries out. The processing composition preferably includes a viscosity-increasing, film-forming polymer of a type and quantity effective, when the applied layer of processing composition solidifies upon drying, to provide a strong bond between the photosensitive element 60 and the spreader sheet 62 and thereby provide a permanent laminate. Since all the layers are transparent, the resulting additive color negative may be projected (printed) without separating the superposed elements.

Figure 7:
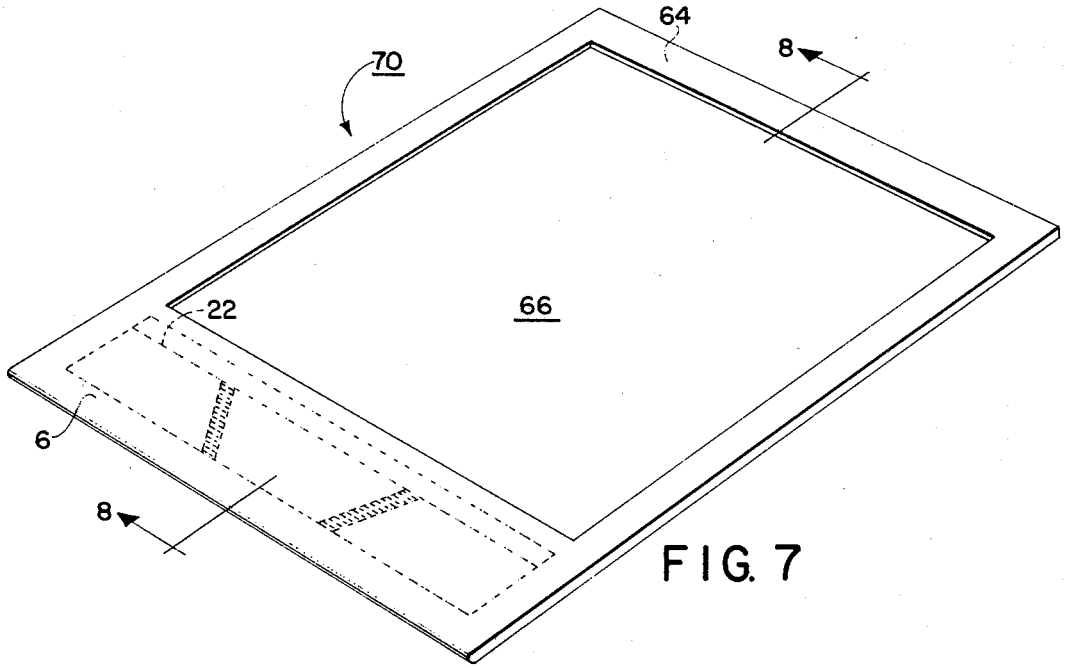
FIG. 7 is a perspective view showing a photographic film unit embodying the components shown in FIG. 6.
Figure 8:
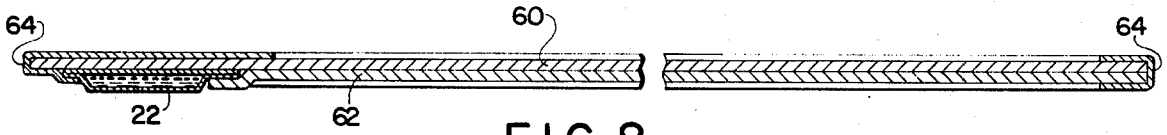
FIG. 8 is a diagrammatic, enlarged, cross-sectional view of the film unit shown in FIG. 7 taken along the section 8—8.

In FIGS. 7 and 8 there is shown a film unit 70, incorporating the prelaminated structure shown in FIG. 6, and adapted to be exposed and processed, e.g., in a Polaroid SX-70 Land camera. This film unit 70 comprises a photosensitive element 60 prelaminated to a transparent spreader sheet 62 with a rupturable container 22 of processing fluid positioned at one end of the film unit. A mask 62 is adhesively attached to the face of the photosensitive element 60 and folded around the edges of the film unit, an aperture in the mask defining the exposure surface and image area 66. The mask 64 secures the edges of the film unit together, and aids in retaining and distributing the processing composition between the superposed sheet-like elements 60 and 62. Suitable trap means (not shown) to collect excess processing composition is provided at the end of the film unit 70 opposite the rupturable container 22.

While the specific film unit 70 illustrated in FIG. 7 is intended to provide a permanently laminated film, it will be understood that this type of film assembly may be provided where it is desired to be able to remove the spreader sheet at some point after processing is completed. In this event, the processing composition is designed to provide a relatively weak bond between the developed photosensitive element 60 and the spreader sheet 62. At such time as it is desired to separate the developed photosensitive element, the mask 64 may be cut along one or more edges of the film unit 70, thereby permitting the desired separation to be effected. The separated photosensitive element containing the desired additive color negative may, if desired, be subjected to any desired aftertreatment, such as washing to remove residual components of the processing composition.

It will also be understood that in a less preferred embodiment, film units of the type illustrated in FIG. 7 need not be prelaminated.

Film assemblies adapted to provide a laminate containing a negative silver image and containing a pH-reducing layer in the spreader sheet are described in U.S. Pat. No. 3,721,562 issued Mar. 20, 1973 to Edwin H. Land. The pH-reducing layer contains an acid-reacting reagent, preferably a polymeric acid, to lower the environmental pH following development of the exposed silver halide emulsion. The final pH thus achieved may be predetermined as the pH at which the developed silver image and/or undeveloped, complexed silver halide is most stable, e.g., to attack by residual components of the processing composition. The optimum final pH for any given film may be readily determined by routine experimentation.

The pH-reducing layer 54 preferably comprises a polymeric acid and is effective to remove alkaline ions and other salt-forming materials from the developed silver halide emulsion layer 14, and/or the solidified layer of processing composition 18, to the pH-reducing layer where they are captured and immobilized by the polymeric acid.

Useful polymeric acids include various polymers containing carboxylic or sulfonic acid groups which are capable of forming salts with the alkaline ions, as well as polymers containing potential acid-yielding groups, such as anhydrides, lactones, etc. The acid polymers found to be most useful are characterized by containing free carboxyl groups, being insoluble in water in the free acid form, and by forming water-soluble sodium salts. One may employ polymers containing carboxylic acid anhydride groups, at least some of which preferably have been converted to free carboxyl groups prior to imbibition. While the most readily available polymeric acids are derivatives of cellulose or of vinyl polymers, polymeric acids from other classes of polymers may be used. As examples of specific polymeric acids contemplated as being used in this invention, reference may be made to U.S. Pat. No. 3,262,819 issued Jan. 9, 1968 to Edwin H. Land and to the aforementioned U.S. Pat. No. 3,721,562. As an example of a polymeric acid particularly useful for this purpose, mention may be made of the partial butyl ester of polyethylene/maleic anhydride copolymer.

It will be appreciated that the pH-reducing action by the polymeric acid should be controlled so as not to interfere with the development step. In order to prevent premature pH reduction, the acid groups are preferably distributed in the acid polymer layer such that the rate of their availability to the alkali is controllable, e.g., as a function of the rate of swelling of the polymer layer, which rate in turn has a direct relationship to the diffusion rate of the alkali ions. The desired distribution of the acid groups in the acid polymer layer may be effected by mixing the acid polymer with a polymer free of acid groups or lower in concentration of acid groups and compatible therewith, or by using only the acid polymer, but selecting one having a relatively lower proportion of acid groups.

The spacer or timing layer 56 is of such a thickness and permeability as to delay or "time" the permeation of the processing compositon therethrough for a period of time sufficient to insure that the resultant alkali neutralization and pH reduction is not premature with consequent adverse effect upon the development of the exposed silver halide emulsion layer. This spacer layer comprises a polymer, or mixture of polymers, inert to alkali but through which the alkaline ions may diffuse to the polymeric acid layer. As examples of useful polymeric materials for this timing layer, mention may be made of polyvinyl alcohol, a partial acetal of polyvinyl alcohol, e.g., partial polyvinyl butyral, gelatin, a polyvinyl amide, a graft polymer, e.g., a polyvinyl amide graft polymer such as the graft copolymer of diacetone acrylamide and acrylamide on polyvinyl alcohol, etc.

Polymeric acid layers and timing layers of the foregoing description have heretofore been contained in image-receiving elements further containing a dyeable stratum and hence are heretofore known in the art. Accordingly, such layers per se comprise no part of this invention. As examples of patents containing such layers as used in color image-receiving elements, mentioned may be made of U.S. Pat. Nos. 3,362,819 issued to Edwin H. Land; U.S. Pat. No. 3,419,389 issued to Howard C. Haas and Henry S. Kolesinski; U.S. Pat. No. 3,421,893 issued to Lloyd D. Taylor; U.S. Pat. No. 3,433,633 issued to Howard C. Haas; and U.S. Pat. No. 3,575,701 issued to Lloyd D. Taylor.

The film unit as illustrated in FIGS. 6 and 7 must be processed in the dark to avoid fogging. Processing may be effected in an SX-70 camera by use of a detachable "dark" processing chamber to receive the film unit upon its ejection from the camera; one such detachable film chamber is described in U.S. Pat. No. 3,650,188 issued Mar. 21, 1972 to James M. Whall. Alternatively, the film unit may include opacifying agents, such as the pH-sensitive optical filter agents or indicator dyes described in U.S. Pat. No. 3,647,437 issued Mar. 7, 1972 to Edwin H. Land. As described in that patent, with particular reference to FIG. 12 thereof, an additive color film may be protected from further exposure during processing by including appropriate pH-sensitive dyes in the processing composition, and by providing a layer (positioned between the silver halide emulsion layer 14 and the additive color screen 12 of FIG. 7 of this application) of a colorless layer of an alkali-activated optical filter agent (to permit exposure therethrough). Application of the alkaline processing composition renders the optical filter agent colored, thereby providing light opacity for the developing silver halide emulsion layer 14 with respect to light incident upon either transparent support 10. After an appropriate time interval, sufficient alkali is neutralized by the pH-reducing layer 54 to reduce the pH to a level effective to decolorize the optical filter agents in the processing composition and in the photosensitive element.

If the film unit is one which will not be retained as a permanent laminate after processing, e.g., if the developed photosensitive element will be separated from the spreader sheet of the processed film unit illustrated in FIG. 4, protection against incident light during processing outside a camera may also be obtained by including a colored pigment, e.g., carbon black, in the processing composition, in accordance with well known techniques. Another technique for providing light opacity during processing outside a camera is to secure a removable, e.g., pressure-sensitive, opaque sheet to the exposure surface of the transparent support 10 after exposure of the film unit illustrated in FIG. 3.

The processing composition may, and preferably does, contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition by the use of one or more alkali metal hydroxides, such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para or ortho positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha$, $\beta$-enediols as disclosed in U.S. Pat. No. 3,730,716 issued to Edwin H. Land, Stanley M. Bloom and Leonard C. Farney on May 1, 1973.

Processing is preferably effected in the presence of a silver halide solvent, whether or not a silver transfer image is to be formed in addition to the additive color negative. Suitable silver halide solvents, for example, may be selected from the alkali metal thiosulfates, particularly sodium or potassium thiosulfates, or the silver halide solvent may be a cyclic imide, such as uracil. While the silver halide solvent is preferably initially present in the processing composition, it is within the scope of this invention to initially position the silver halide solvent in a layer of the film unit, preferably in the form of a precursor which releases or generates the silver halide solvent upon contact with an alkaline processing fluid.

It is also within the scope of this invention to utilize antifoggants and/or image toning agents in concentrations well known in the art, and incorporated in the photosensitive element and/or in the processing composition in accordance with well known practices.

The provision of a processing composition permeable layer, (sometimes referred to as an "overcoat" or "top coat"), free of silver halide or silver precipitating agent, as the outermost layer, e.g., in the position of layer 16 in FIGS. 2, 3 and 6, has been found to provide a number of useful benefits. Such a layer may be used to carry one or more reagents useful in the process, such as the anti-halation dyes and/or image stabilizing agents described above. It is believed that this overcoat may exert a useful modulating effect in the rate and/or concentration at which components of the processing composition contact the silver halide, particularly where this overcoat is coated directly over the silver halide emulsion, and promote a more uniform processing composition wave front and permeation. Suitable processing composition permeable polymers may be readily selected to provide the particular properties and the degree of modulation desired. As examples of preferred materials, mention may be made of gelatin and cellulose acetate hydrogen phthalate. The former may be deposited over the emulsion layer from a water solution whereas the latter may be deposited from a suitable solvent such as an organic solvent, e.g., an acetone/ethanol mixture. Other suitable polymers include polyvinyl alcohol and polyvinyl pyrrolidone. The polymeric layer may be cross-linked or hardened to control the rate of permeation and degree of swelling. As examples of hardening agents which have been found useful, particularly with gelatin layers useful in practicing this invention, mention may be made of chrome alum and alginates, such as propylene glycol alginate. The presence of an overcoat layer also is advantageous in minimizing "salting out" of components of the processing fluid on the surface of the developed film where the processing fluid is not removed. A particularly useful overcoat layer is a coating of about 80 to 250 mg./ft.$^2$ of gelatin.

The particular dye or dyes used to provide the individual color screen filter elements may be selected in accordance with principles well known in the art and per se form no part of the present invention. It is also known in the art that the individual filter elements need not be equal in area, and some variation in the relative areas occupied by the individual colors may be desirable to obtain a color balance as the result of the color transmission properties of individual dyes. Examples of suitable dyes for use in forming additive color screens are set forth in the previously cited patents related to additive color photography and in other patents, e.g., U.S. Pat. No. 3,730,725 issued May 1, 1973 to E. M. Idelson, the copending application of E. M. Idelson, Ser. No. 319,905 filed Dec. 29, 1972, (now abandoned in favor of a continuation-in-part, Ser. No. 511,461 filed Oct. 3, 1974) and the copending application of L. Locatell, Jr., Ser. No. 319,223 filed Dec. 29, 1972 (now abandoned).

The following examples of the preparation of an additive color negative in accordance with this invention are set forth for illustrative purposes only.

EXAMPLE 1

A transparent polyethylene terephthalate film base bearing an additive color screen composed of approximately 1,000 triplet sets of red, green and blue dyed dichromated gelatin filter lines was prepared by the procedure described in the above-mentioned U.S. Pat. No. 3,284,208. A 1.5 micron barrier layer of "Saran" polyvinylidene chloride polymer (Saran is a trademark of Dow Chemical Co.) was coated over the additive color screen. A solution comprising deacetylated chitin, acetic acid and a wetting agent (Neutronyx 650 nonionic surfactant, Onyx Chemical Co.) was then applied to provide a subcoat comprising approximately 7.0 mgs./ft.$^2$ of deacetylated chitin. A photosensitive silver halide layer was then applied over the deacetylated chitin layer, using a panchromatically sensitized, predominantly homogeneous silver iodobromide (4 mole percent iodide) silver halide emulsion (mean grain diameter 0.84 micron) prepared by a double jet precipitation. The silver halide layer contained approximately 142 mgs./ft.$^2$ of gelatin, approximately 142 mgs./ft.$^2$ of silver and 10.7 mgs./ft.$^2$ of propylene glycol alginate. The silver halide emulsion layer was then overcoated with an anti-halation layer comprising 110 mgs./ft.$^2$ of gelatin, 2.8 mgs./ft.$^2$ of a cyan anti-halation dye, 3.0 mgs./ft.$^2$ of a yellow anti-halation dye and 5.0 mgs./ft.$^2$ of a gold compound (image stabilizer) of the type described in the aforementioned U.S. Pat. No. 3,704,126. This photosensitive element was photoexposed to a multicolor step wedge and a layer approximately 0.0033 inch thick of processing composition was applied between the anti-halation layer and a Polaroid Land Type 107 silver image-receiving element. The processing composition comprised:

| | |
|---|---|
| Potassium hydroxide | 8.94 g. |
| Hydroxyethyl cellulose (high viscosity) | 3.04 g. |
| Tetramethyl reductic acid | 3.57 g. |
| Sodium sulfite | 2.23 g. |
| 6-methylthiomethyl uracil | 7.15 g. |
| Water to make 100 cc. | |

After about 30 seconds imbibition the two sheets were separated. An additive color negative image and a black-and-white positive silver transfer image were obtained. The neutral (maximum exposure) column of the additive color negative image exhibited the following transmission densities:

| | Red | Green | Blue |
|---|---|---|---|
| $D_{max.}$ | 1.28 | 1.24 | 1.24 |
| $D_{min.}$ | 0.43 | 0.34 | 0.33 |

The cyan (red exposure) color column exhibited maximum and minimum transmission densities of 1.37 and 0.42. The magenta (green exposure) color column exhibited maximum and minimum transmission densities of 1.27 and 0.34. The yellow (blue exposure) color column exhibited maximum and minimum transmission densities of 1.32 and 0.32.

(The use of 6-methylthiomethyl uracil as a silver halide solvent is the subject of the copending application of Richard B. Greenwald, Ser. No. 463,263, filed concurrently herewith, now abandoned in favor of a continuation-in-part, Ser. No. 563,306, filed April 1, 1975.)

EXAMPLE 2

The procedure described in Example 1 was repeated using a layer approximately 0.0030 inch thick of the following processing composition:

| | |
|---|---|
| Sodium hydroxide | 5.79 g. |
| Sodium sulfite | 1.87 g. |
| Tetramethyl reductic acid | 7.69 g. |
| Sodium thiosulfate pentahydrate | 6.84 g. |
| Hydroxyethyl cellulose (high viscosity) | 2.99 g. |
| Water to make 100 cc. | |

After 30 seconds imbibition, the two sheets were separated. An additive color negative and a black-and-white positive silver transfer image were obtained. The neutral (maximum exposure) column of the additive color negative image exhibited the following transmission densities:

| | Red | Green | Blue |
|---|---|---|---|
| $D_{max.}$ | 0.96 | 0.92 | 0.86 |
| $D_{min.}$ | 0.28 | 0.22 | 0.20 |

The cyan (red exposure) column exhibited maximum and minimum transmission densities of 1.09 and 0.26. The magenta (green exposure) column exhibited maximum and minimum transmission densities of 1.03 and 0.22. The yellow (blue exposure) column exhibited maximum and minimum transmission densities of 1.01 and 0.20.

EXAMPLE 3

The procedure described in Example 2 was repeated, omitting the anti-halation layer, and the layer of processing composition was approximately 0.0022 inch thick. The neutral (maximum exposure) column of the additive color negative image exhibited the following transmission densities:

| | Red | Green | Blue |
|---|---|---|---|
| $D_{max.}$ | 1.12 | 1.10 | 1.10 |
| $D_{min.}$ | 0.31 | 0.21 | 0.22 |

The cyan (red exposure) column exhibited maximum and minimum transmission densities of 1.30 and 0.31. The magenta (green exposure) column exhibited maximum and minimum transmission densities of 1.21 and 0.25. The yellow (blue exposure) column exhibited maximum and minimum transmission densities of 1.26 and 0.25.

Analysis of the color columns (red, green and blue exposures) of the additive color negative images prepared in the above Examples 2 and 3 showed that greater color separation was obtained with the additive color photosensitive element of Example 2 containing an anti-halation layer e.g., the cyan (red exposure) column exhibited less green and blue absorption, indicating less development of silver halide behind the green and blue filter elements when the only exposure light was red. The increased color separation was particularly evident at the higher exposure levels.

The additive color negative images obtained in the above examples exhibited low contrast and long scales, i.e., extended dynamic ranges.

It is a significant feature of the present invention that the additive color negatives provided by this invention may be used to provide full color positive prints or transparencies using conventional subtractive color printing paper or transparency film. It will be recognized by those skilled in the art that, as in any color printing system, the light transmitting by the color negative may have to be filtered to conform to the spectral sensitivity characteristics of the color reproduction material being used to obtain good color balance in the resulting positive image. Such filtration techniques during printing to adjust color balance are conventional, and are discussed, for example, in "Printing Color Negatives", Eastman Kodak Pulbication No. E-66, 4th edition (1970). In the above examples, the red, green and blue dyes utilized to provide the additive color screen were ones selected for spectral transmission properties suitable for projecting additive color positive transparencies. When additive color negatives containing such additive color screens were printed onto Kodak Ektacolor 37 RC paper, it was found that the blue filter element of the additive color screen transmitted light within the long red (720 m$\mu$) sensitivity range of the Ektacolor paper, thus confusing the blue and red negative records. Accordingly, printing of these additive color negatives was effected through a filter pack which absorbed the undesired red transmission through the blue color filter element, and also absorbed sufficient blue and green light to rebalance the exposure. It is, of course, within the scope of this invention and a preferred embodiment to form the additive color screen using dyes whose spectral transmission properties are consistent with the sensitivities of the color printing materials contemplated to be used therewith.

4 × 5 additive color negatives were prepared using the film arrangement and assembly of the type shown in U.S. Pat. No. 3,586,501 issued June 22, 1971 to Warren E. Norquist et al., and components of the type described in the above examples. The 4 × 5 additive color negatives, or portions thereof, were enlarged to 20 × 24 prints using Kodak Ektacolor 37 RC paper and Kodak Ektaprint 3 processing chemicals. The enlargements were a minimum of 7 to 8X. Examination of such enlargements through a 5 power lens failed to reveal any pattern of the additive color screen. The enlargements exhibited excellent resolution and color quality.

It will be recognized that the additive color negatives provided by this invention utilize a single panchromatically sensitized silver halide layer as compared with the three or more different, color sensitized silver halide layers utilized in the conventional, widely used subtractive color negative films. The elimination of such additional silver halide layers, together with the use of extremely small color filter screen elements, contributes substantially to the high resolution exhibited by the additive color negatives when printed onto subtractive color positive materials.

In the embodiments of the invention described above, the exposed additive color photosensitive elements has been processed against a spreader sheet (such as a sheet of polyethylene terephthalate or cellulose acetate) or against a silver image-receiving element. It has also been found that a sheet of fogged film, i.e., a suuport carrying one or more layers of fogged silver halide emulsion, may be used as the spreader sheet. In such an embodiment, silver halide developing agent which is not oxidized by development of photoexposed silver halide in the exposed additive color photosensitive element will diffuse to the fogged silver halide and reduce it. This technique is effective to remove unused silver halide developing agent from the developed additive color negative.

EXAMPLE 4

Film units like that shown in FIGS. 6, 7 and 8 were assembled using additive color photosensitive elements (no anti-reflection coating 16) similar to those described in Examples 1 to 3 and a pH-reducing spreader sheet comprising 4 mil polyethylene terephthalate coated, in succession, with the following layers: (a) as a polymeric acid layer, a partial butyl ester of polyethylene/maleic anhydride copolymer at a coverage of about 2,500 mgs./ft.$^2$; (b) a layer containing about a 40:1 ratio of a 60-30-4-6 copolymer of butylacrylate, diacetone acrylamide, styrene and methacrylic acid and polyacrylamide at a coverage of about 500 mgs./ft.$^2$; and (c) a layer containing a 2:1 mixture, by weight, of polyvinyl alcohol and poly-4-vinylpyridine at a coverage of about 300 mgs./ft.$^2$ and a small quantity of 4,5-cyclopentahexahydropyrimidine-2-thione. The pH-reducing spreader sheet was temporarily laminated to the additive color photosensitive element using a solution of polyethylene glycol in the manner described in the above-mentioned U.S. Pat. No. 3,793,023 issued Feb. 19, 1974 to Edwin H. Land. The film units were exposed in a Polaroid SX-70 Land camera, and ejected directly from the camera into a light-tight detachable chamber. After 30 seconds in this dark chamber, the film units were removed. The additive color negatives thus developed were used to print full color positives on Kodak Ektacolor 37 RC paper without separation of the transparent pH-reducing spreader sheet, the used pod or the trap, i.e., by projection through the laminate of the two sheets.

In the illustrative examples given above, the additive color negatives were used to print full color positives without further treatment. If desirable, the additive color negatives obtained in accordance with this invention may be washed or subjected to other aftertreatment, e.g., to remove residual processing composition, to maximize stability, to bleach an anti-halation layer, to remove undeveloped silver halide. Treatment of a developed additive color negative in a conventional "hypo" fix bath may be used to reduce the minimum transmission density of the negative, e.g., by about 0.1 to 0.2. Such an increase in the delta between maximum and minimum transmission densities may be particularly desirable to facilitate printing of some additive color negatives.

The film units described in connection with FIGS. 3 and 6 included an anti-reflection layer. The provision of an anti-reflection layer through which photoexposure is made is described in detail in U.S. Pat. No. 3,793,022 issued Feb. 19, 1974 to Edwin H Land, Stanley M. Bloom and Howard G. Rogers, and in the copending application of the just-mentioned inventors, Ser. No. 428,368, filed Dec. 26, 1973 (now abandoned in favor of a continuation-in-part, Ser. No. 602,462, filed Aug. 6, 1975). In the preferred embodiments, the anti-reflection layer comprises a quarter-wave optical thickness of a perfluorinated polymer having an index of refraction of about 1.4 where the transparent support has an index of refraction of about 1.6 or higher.

As noted above, it is desired in the practice of the present invention to develop developable silver halide grains under conditions which will substantially increase the projected area of the grain, i.e., the developed silver grain will have a substantially larger projected area than the undeveloped silver halide grain. Examination of optical and electron micrographs of silver grains forming additive color negative images by procedures substantially like those described in Examples 1–3 indicate that the developed silver grains have diameters 2 to 2.5 times the mean diameter (0.82 micron) of the undeveloped silver halide grains.

It has been found that enlargement of the silver halide grains upon development is greater when there is no sulfite or only a low concentration of sulfite, e.g., the minimum sulfite necessary to bleach the anti-halation dyes. The ratio of silver halide development agent to silver halide solvent also has been found to influence the degree of grain enlargement upon development. The particular ratio of these components of the processing composition which will give the greatest grain enlargement of a given silver halide emulsion may be readily determined by routine scoping of these components, preferably holding the alkali concentration constant.

Transmission densities set forth above are measured above base density.

The additive color negatives provided by the present invention may be used to print three color separation positive matrices for use in dye transfer photographic processes. These additive color negatives are particularly suited for this use since the individual red, green and blue negative silver records are very closely matched in curve shape.

It has been noted earlier that the additive color negatives obtained in the practice of the present invention may be viewed as full color positive images by known electronic systems. One such system is embodied in the Kodak Video Color Negative Analyzer, Model 1-K which provides a 5 × 5 positive color television image from popular size Kodacolor-X and Ektacolor negatives. This equipment is discussed on pages 34 and 35 of the previously mentioned Kodak publication "Printing Color Negatives".

In those embodiments which provide a positive silver transfer image in addition to an additive color negative, the silver receptive layer may be on a transparent support instead of using a paper support as in FIG. 3. Alternatively, the positive silver transfer image may be formed in the layer of processing composition, said layer preferentially adhering to a transparent spreader sheet such as shown in FIG. 2. The incorporation of silver precipitating agents into a processing composition to form a silver transfer image in a layer of such processing composition is disclosed in U.S. Pat. No. 2,662,822 issued Dec. 15, 1953 to Edwin H. Land.

It will be recognized that light incident upon the exposure surface of certain embodiments of this invention, e.g., of embodiments shown in FIGS. 2, 6 and 7, may pass through all the layers of the additive color photosensitive element and the associated spreader sheet. If the film unit is part of a film pack containing a plurality of such film units, the light so transmitted could effect a photoexposure of at least the next underlying film unit. This problem may be readily avoided by interposing opaque members between the stacked film units. Such an opaque member may be a separate opaque interleaf sheet positioned between film units, or it may be an opaque layers so secured to the outer surface of the second (back) transparent support, e.g., by a peelable or other temporary adhesive layer, as to be readily removed after processing. Still another technique for accomplishing such protection against premature exposure of underlying film units is to provide an anti-halation layer 16 containing bleachable dyes and of sufficient density to prevent such undesired light transmission. While the density of such an anti-halation layer might have to be greater than would be necessary if it were only used to provide anti-halation, the density need not be very great since the exposure time is normally very short.

Rupturable container 22 may be of the type shown and described in any of U.S. Pat. Nos. 2,543,181; 2,634,886; 2,653,732; 2,723,051; 3,056,492; 3,056,491; 3,152,515; and the like. A particularly useful rupturable container for use in film units of the type shown in FIG. 7 is described and claimed in the copending application of Stanley M. Bloom, Ser. No. 756,838, filed Sept. 3, 1968, now U.S. Pat. No. 3,575,699 issued Apr. 20, 1971. In general, such containers will comprise a rectangular blank of fluid- and air-impervious sheet material folded longitudinally upon itself to form two walls which are sealed to one another along their longitudinal and end margins to form a cavity in which processing composition 18 is retained. The longitudinal marginal seal is made weaker than the end seals so as to become unsealed in response to the hydraulic pressure generated within the fluid contents 18 of the container by the application of compressive pressure to the walls of the container, e.g., by passing the film unit between opposed pressure applying members, e.g., rollers.

It will be understood that the novel photographic products of this invention may be exposed in cameras which utilize mirrors in the optical path to reverse the image, as well as in cameras whose optical systems are not image-reversing.

It is also within the scope of the present invention to provide additional density in the developed areas, i.e., density in addition to that provided by the developed silver, by utilizing a silver halide developing agent which has a colored oxidation product or which may undergo reaction with a colorless component, e.g., a color coupler, to provide a colored product in the developed areas. Such colored development oxidation products should be non-diffusible and stable under the conditions to which the additive color negative will be subjected.

Reference herein to the silver transfer image provided in certain embodiments as being a "black-and-white" image is intended to mean that this image is a monotone. Where desired, suitable toning agents known in the art may be included to modify the tone of the silver transfer image to a more neutral tone, e.g., black or blue-black.

In the embodiments described above, the processing composition has been applied from a single use, rupturable container (pod) or from a container holding a quantity of processing composition sufficient to process a plurality of individual frames (images). It is also within the scope of this invention to provide the processing composition in the form of a liquid-impregnated sheet which is pressed against the permeable surface of the exposed photosensitive element. If the liquid-impregnated sheet is transparent, it need not be removed after processing but may be retained with the developed additive color negative as a permanent laminate.

The present invention may be practiced in cameras using Polaroid Land Series 80 and 100 film by use of film assemblies similar to those shown in U.S. Pat. No. 3,682,637 issued Aug. 8, 1972 to Edwin H. Land.

As noted above, it is frequently advantageous to provide a stripping layer on the surface of the photosensitive element to facilitate removal of the layer of processing composition by preferential adhesion to the spreader sheet when the spreader sheet is separated at the end of the processing period. Techniques for providing such preferential adhesion to either of the superposed sheets, as desired, are known in the art and are described, for example, in U.S. Pat. No. 2,647,056 issued July 28, 1953 to Edwin H. Land. As examples of materials suitable as strip coats, mention may be made of gum arabic and cellulose acetate hydrogen phthalate.

Because the red, green and blue image records are separate and side-by-side, such additive color negatives do not require the integral masking conventional in subtractive color negatives. As a result, there is greater flexibility in selecting dyes used in the color filter elements.

It will be seen from the above description and illustrative examples that this invention has provided novel photographic products and processes which provide additive color negatives by very simple and rapid processing. The convenience and rapidity of self-developing films and one-step photography have thus been extended to the provision of color negatives, i.e., additive color negatives, fully compatible with the most widely used subtractive color printing positive materials.

Since certain changes may be made in the above product and processes without departing from the scope of the invention herein involved, it is intended that all matter contained in the above description or shown in the accompanying drawings shall be interpreted as illustrative and not in a limiting sense.

What is claimed is:

1. A photographic color process comprising photoexposing a photosensitive element comprising a transparent support carrying (a) a light-transmitting screen composed of minute optical elements and (b) a layer containing a photosensitive silver halide emulsion, said photoexposure being effected through said light-transmitting screen; and developing the developable image formed by said photoexposure to form a silver image in said developed silver halide emulsion layer in registration with said light-transmitting screen; said development being effective to substantially increase the projected area of the silver halide grains developed to provide said silver image; transferring at least a portion of the undeveloped silver halide from said developed silver halide emulsion by diffusion, as a soluble silver complex, to a superposed silver-receptive stratum to provide a silver transfer image, said silver transfer image being a reversal image of the silver image developed in said photoexposed silver halide emulsion layer; said process including the step of separating said silver-receptive stratum carrying said silver transfer image from said developed silver halide emulsion and said light-transmitting screen.

2. A photographic color process as defined in claim 1 wherein said light-transmitting screen is an additive color screen composed of sets of interspersed minute color filter elements, the color filter elements of each set transmitting the same predetermined wavelength range of visible light.

3. A photographic color process as defined in claim 2 wherein said additive color screen is composed of red, green and blue filter elements.

4. A photographic color process as defined in claim 2 wherein said silver halide grains have a mean diameter of about 1/5 to 1/10 the width of said color filter elements.

5. A photographic color process as defined in claim 1 wherein said silver halide grains have a mean diameter within the range of about 0.7 to 1.5 micron.

6. A photographic color process as defined in claim 5 wherein at least 90% of said silver halide grains have a diameter within ±30% of the mean grain diameter.

7. A photographic color process as defined in claim 1 wherein said silver halide grains have a mean diameter of about 0.9 micron.

8. A photographic color process as defined in claim 1 wherein said silver halide emulsion layer contains about 90 to 200 mg./ft.$^2$ of silver.

9. A photographic color process as defined in claim 1 wherein said minute optical elements are lenticules.

10. A photographic color process as defined in claim 2 wherein said red, green and blue filter elements are in the forms of lines, and said additive color screen contains approximately 550 lines/color/inch.

11. A photographic color process as defined in claim 2 wherein said red, green and blue filter elements are in the form of lines, and said additive color screen contains approximately 750 lines/color/inch.

12. A photographic color process as defined in claim 2 wherein said red, green and blue filter elements are in the form of lines, and said additive color screen contains approximately 1000 lines/color/inch.

13. A photographic color process as defined in claim 1 wherein said silver halide emulsion is a substituted-halide silver halide emulsion prepared by replacing part of the chloride anions of a silver chloride emulsion with bromide anions or with bromide and iodide anions.

14. A photographic color process as defined in claim 1 wherein said silver halide emulsion is a negative-working silver halide emulsion and said silver image is a negative image of the subject of said photoexposure.

15. A photographic color process as defined in claim 1 wherein said silver emulsion is a direct positive emulsion and said development silver image is a positive image of the subject of said photoexposure.

16. A photographic color process as defined in claim 2 wherein said silver halide emulsion is a negative-working silver halide emulsion and said silver image is a negative image of the subject of said photoexposure.

17. A photographic color process as defined in claim 1 wherein said developed silver image has a maximum transmission density of at least about 0.8.

18. A photographic color process as defined in claim 16 wherein said developed negative silver image has a maximum transmission density of at least about 0.8.

19. A photographic color process as defined in claim 16 including the step of printing said negative silver image onto a multicolor positive printing paper through said additive color screen to provide a multi-color positive image of said additive color negative image.

20. A photographic process as defined in claim 1 wherein said developed silver image has a maximum transmission density of about 1.2 to 1.4.

21. A photographic process as defined in claim 1 wherein said silver halide emulsion layer contains about 140 mg./ft.$^2$ of silver.

22. A photographic process as defined in claim 1 wherein said development is effected in the presence of a concentration of silver halide solvent relative to the concentration of the silver halide developing agent which is effective to substantially increase the projected area of the silver halide grains which are developed.

23. A photographic process as defined in claim 22 wherein said increase in projected area of individual grains is an average of at least about 2 to 2.5X.

24. A photographic color process as defined in claim 1 wherein said development is effected by distributing a viscous processing composition between said exposed photosensitive element and a second sheet-like element in superposed relationship therewith.

25. A photographic color process as defined in claim 1 wherein said photosensitive element includes an anti-halation layer positioned to minimize lateral backscatter of light passing through said silver halide emulsion layer.

26. A photographic color process as defined in claim 24 wherein said second sheet-like element is transparent.

27. A photographic product for providing an additive color negative for printing color positive images, said product comprising a photosensitive sheet-like element, a second sheet-like element, and a rupturable container releasably holding a processing composition, said photosensitive element and said second sheet-like element being in or adapted to be brought into superposed relationship with said rupturable container so positioned as to release said processing composition for distribution between said superposed elements; said photosensitive element comprising a transparent support, an additive color screen, and a photosensitive silver halide emulsion, said additive color screen being positioned between said transparent support and said photosensitive silver halide emulsion; said processing composition being adapted to develop said silver halide emulsion to provide said additive color negative; said second sheet-like element including a silver receptive stratum for providing a black-and-white silver transfer image which is a positive of said additive color negative; said sheet-like elements being adapted to be separated after formation of said images, said additive color screen remaining with said silver halide emulsion.

28. A photographic product as defined in claim 26 wherein said additive color screen is composed of sets of interspersed minute color filter elements, the color filter elements of each set transmitting the same predetermined wavelength range of visible light.

29. A photographic product as defined in claim 27 wherein said additive color screen is composed of red, green and blue filter elements.

30. A photographic product as defined in claim 28 wherein said red, green and blue filter elements are in the form of lines, and said additive color screen contains approximately 750 lines/color/inch.

31. A photographic product as defined in claim 29 wherein said red, green and blue filter elements are in the form of lines, and said additive color screen contains approximately 1,000 lines/color/inch.

32. A photographic product as defined in claim 29 wherein the silver halide grains of said silver halide emulsion have a mean diameter of about 1/5 to 1/10 the width of said color filter elements.

33. A photographic product as defined in claim 32 wherein at least 90% of said silver halide grains have a diameter within ±30% of said mean grain diameter.

34. A photographic product as defined in claim 32 wherein said silver halide grains have a mean diameter of about 0.7 to 1.5 micron.

35. A photographic product as defined in claim 27 wherein said silver halide emulsion contains about 90 to about 200 mgs./ft.$^2$ of silver.

36. A photographic product as defined in claim 27 wherein said silver halide emulsion is a silver iodobromide emulsion.

37. A photographic product as defined in claim 29 wherein said silver halide emulsion is a silver iodochlorobromide emulsion.

38. A photographic product as defined in claim 26 wherein said silver halide emulsion is a silver bromide emulsion.

39. A photographic product as defined in claim 27 wherein the outermost coating of said photosensitive element is a stripping layer whereby the layer of said processing composition will preferentially adhere to said second sheet-like element upon separation of said elements after processing.

40. A photographic product as defined in claim 29 including an antihalation layer positioned on the side of said silver halide emulsion layer opposite the exposure surface of said silver halide emulsion layer.

41. A photographic product as defined in claim 27 including means to protect said silver halide emulsion from further exposure during processing in a lighted area.

42. A photographic product as defined in claim 27 including a removable opaque layer.

43. A photographic product as defined in claim 42 wherein said processing composition includes an opacifying agent.

44. A photographic product as defined in claim 27 wherein said processing composition includes a silver halide developing agent and a silver halide solvent, the ratio of said silver halide solvent to said silver halide developing agent being effective to substantially increase the projected area of silver halide grains which are developed.

45. A photographic process comprising exposing a photosensitive element comprising a transparent support carrying an additive color screen and a silver halide emulsion layer, said exposure of said silver halide emulsion being effected through said additive color screen; developing said exposed silver halide emulsion to provide a negative image in silver in said silver halide emulsion layer in registration with said additive color screen; forming an imagewise distribution of soluble silver complex in undeveloped areas of said silver halide emulsion as a function of said development; transferring at least a portion of said soluble silver complex from said silver halide emulsion layer to a silver receptive stratum in superposed relationship with said silver halide emulsion to thereby impart to said silver receptive stratum a reversal image in silver; separating said silver receptive stratum containing said reversal silver transfer image from the negative additive color image in said developed photosensitive element; and printing a multicolor positive image from said negative additive color image by a subtractive color process.

46. A photographic product adapted to provide an additive color negative and consisting essentially of a transparent support carrying, in sequence, an additive color screen and a silver halide emulsion layer; said additive color screen being composed of interspersed red, green and blue filter lines, said additive color screen containing approximately 1000 lines/color/inch; said silver halide emulsion being predominantly homogeneous in grain size and having a mean grain diameter of about 1/5 to 1/10 the width of said filter lines; said silver halide emulsion layer containing about 90 to 200 mgs./ft.$^2$ of silver; the sum of the projected areas of said silver halide grains being not more than about 50 to 60% of the surface area of said silver halide emulsion layer.

47. A photographic product as defined in claim 46 wherein said silver halide emulsion layer contains about 140 mgs./ft.$^2$ of silver.

48. A photographic product as defined in claim 46 wherein said mean grain diameter of said silver halide emulsion is about 0.8 to about 0.9 micron.

49. A photographic product as defined in claim 46 wherein said silver halide emulsion layer is substantially free of overlapping silver halide grains.

50. A photographic product as defined in claim 46 including an anti-halation layer coated on the surface of said silver halide emulsion layer opposite the exposure surface thereof.

51. A photographic process comprising exposing a photosensitive element comprising a transparent support carrying an additive color screen and a silver halide emulsion layer, said exposure of said silver halide emulsion being effected through said additive color screen; developing said exposed silver halide emulsion to provide a negative image in silver in said silver halide emulsion layer in registration with said additive color screen; transferring, by diffusion, silver halide developing agent not oxidized by development of exposed silver halide to a superposed layer of fogged silver halide carried by a second support; and separating said fogged silver halide layer and second support from the negative additive color image in said developed photosensitive element.

52. A photographic product for providing an additive color negative for printing color positive images, said product comprising a photosensitive sheet-like element, a second sheet-like element, and a rupturable container releasably holding a processing composition, said photosensitive element and said second sheet-like element being in or adapted to be brought into superposed relationship with said rupturable container so positioned as to release said processing composition for distribution between said superposed elements; said photosensitive element comprising a transparent support, an additive color screen, and a photosensitive silver halide emulsion layer; said additive color screen being positioned between said transparent support and said silver halide emulsion layer, and being composed of interspersed red, green and blue lines; said silver halide emulsion being predominantly homogeneous in grain size and having a mean diameter of about 1/5 to 1/10 the width of said filter lines, said mean diameter being about 0.7 to 1.5 micron; said silver halide emulsion layer containing about 90 to 200 mgs./ft.$^2$ of silver; the sum of the projected areas of said silver halide grains being not more than about 50 to 60% of the surface area of said silver halide emulsion layer; said processing composition being adapted to develop said silver halide emulsion to provide said additive color negative; said second sheet-like element being transparent and including a pH-reducing layer for neutralizing alkali provided by said processing composition; said sheet-like elements being free of silver precipitating agents; said processing composition being adapted, when distributed between said elements, to provide a permanent, transparent laminate of said elements.

53. A photographic product as defined in claim 52 wherein said additive color screen contains approximately 750 lines/color/inch.

54. A photographic product as defined in claim 52 wherein said additive color screen contains approximately 1000 lines/color/inch.

55. A photographic product as defined in claim 52 wherein at least 90% of said silver halide grains have a diameter within ± 30% of said mean grain diameter.

56. A photographic product as defined in claim 52 wherein said silver halide emulsion is a silver iodobromide emulsion.

57. A photographic product as defined in claim 52 wherein said silver halide emulsion is a silver iodochlorobromide emulsion.

58. A photographic product as defined in claim 52 wherein said silver halide emulsion is a silver bromide emulsion.

59. A photographic product as defined in claim 52 wherein said second sheet-like element includes a spacer layer adapted to delay the pH-reducing action of said pH-reducing layer.

60. A photographic product as defined in claim 52 including an antihalation layer positioned on the side of said silver halide emulsion layer opposite the exposure surface of said silver halide layer.

61. A photographic product as defined in claim 52 including means to protect said silver halide emulsion from further exposure during processing in a lighted area.

62. A photographic product as defined in claim 61 including a removable opaque layer.

63. A photographic product as defined in claim 61 wherein said processing composition includes an opacifying agent.

64. A photographic product as defined in claim 52 wherein said elements comprise a temporary laminate of said elements with their respective supports positioned outermost, said container of processing composition being positioned to distribute said processing composition between said elements, the bond between said elements being relatively weak so that distribution of said processing composition will delaminate said elements.

65. A photographic product as defined in claim 64 wherein said bond between said elements is provided by a stratum of a high molecular weight polyethylene glycol.

66. A photographic product adapted to provide an additive color negative and consisting essentially of a transparent support carrying, in sequence, an additive color screen and a silver halide emulsion layer; said additive color screen being composed of interspersed red, green and blue filter lines, said additive color screen containing approximately 750 lines/color/inch; said silver halide emulsion being predominantly homogeneous in grain size and having a mean grain diameter of about 1/5 to 1/10 the width of said filter lines; said silver halide emulsion layer containing about 90 to 200 mgs./ft.$^2$ of silver; the sum of the projected areas of said silver halide grains being not more than about 50 to 60% of the surface area of said silver halide emulsion layer.

67. A photographic product as defined in claim 66 wherein said silver halide emulsion layer contains about 140 mgs./ft.$^2$ of silver.

68. A photographic product as defined in claim 66 wherein said mean grain diameter of said silver halide emulsion is about 0.8 to about 0.9 micron.

69. a photographic product as defined in claim 66 including an anti-halation layer coated on the surface of said silver halide emulsion layer opposite the exposure surface thereof.

70. A photographic product adapted to provide an additive color negative and consisting essentially of a transparent support carrying, in sequence, an additive color screen and a silver halide emulsion layer; said additive color screen being composed of interspersed red, green and blue filter lines, said additive color screen containing approximately 550 lines/color/inch; said silver halide emulsion being predominantly homogeneous in grain size and having a mean grain diameter of about 1/5 to 1/10 the width of said filter lines; said silver halide emulsion layer containing about 90 to 200 mgs./ft.$^2$ of silver; the sum of the projected areas of said silver halide grains being not more than about 50 to 60% of the surface area of said silver halide emulsion layer.

71. A photographic product as defined in claim 70 wherein said silver halide emulsion layer contains about 140 mgs./ft.$^2$ of silver.

72. A photographic product as defined in claim 70 wherein said mean grain diameter of said silver halide emulsion is about 0.8 to about 0.9 micron.

73. A photographic product as defined in claim 70 including an anti-halation layer coated on the surface of said silver halide emulsion layer opposite the exposure surface thereof.

* * * * *

UNITED STATES PATENT AND TRADEMARK OFFICE

CERTIFICATE OF CORRECTION

PATENT NO. : 3,990,895

DATED : November 9, 1976

INVENTOR(S) : Edwin H. Land

It is certified that error appears in the above-identified patent and that said Letters Patent are hereby corrected as shown below:

Column 1, line 45, "as" should be --an--.

Column 6, line 66, "grain" should be --grains--.

Column 16, line 15, "62" should be --64--.

Column 16, line 28, after "assembly" insert --also.

Column 22, line 35, "transmitting" should be --transmitted--.

Column 23, lines 20 and 21, "elements" should be --element--.

Column 25, line 27, "layers" should be --layer--.

Column 28, line 7, "development" should be --developed--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*